United States Patent [19]

Belluomo

[11] 3,982,297

[45] Sept. 28, 1976

[54] AUTOMATIC CLEANER

[76] Inventor: Carl Belluomo, 248 Brinsmade Ave., Bronx, N.Y. 10465

[22] Filed: May 27, 1975

[21] Appl. No.: 580,665

[52] U.S. Cl. ..... 15/97 R; 15/23

[51] Int. Cl.[2] ..... A46B 13/02

[58] Field of Search ..... 15/23, 24, 28, 29, 97 R, 15/230 R; 51/170 PT

[56] References Cited

UNITED STATES PATENTS

| | | | |
|---|---|---|---|
| 1,901,825 | 3/1933 | Siebert et al. | 15/230 X |
| 2,287,725 | 6/1942 | Conte | 15/23 |
| 2,314,117 | 3/1943 | Beckner | 15/23 |
| 2,579,154 | 12/1951 | Morrison, Jr. | 51/170 PT UX |
| 3,034,376 | 5/1962 | Gonzalez | 15/23 X |
| 3,343,192 | 9/1967 | Goldstein et al. | 15/23 |
| 3,725,969 | 4/1973 | Horeni | 15/230 |

FOREIGN PATENTS OR APPLICATIONS

| | | | |
|---|---|---|---|
| 1,023,565 | 12/1952 | France | 15/23 |
| 1,092,408 | 11/1954 | France | 15/23 |
| 250,767 | 9/1947 | Switzerland | 15/23 |

*Primary Examiner*—Edward L. Roberts
*Attorney, Agent, or Firm*—Richard L. Miller

[57] ABSTRACT

An electrical appliance in which a motor-driven roller is rotated, the roller being fitted with any type sleeve designed for a specific task such as washing a window glass, sanding a car body or buffing a surface of an object.

3 Claims, 6 Drawing Figures

Fig. 1
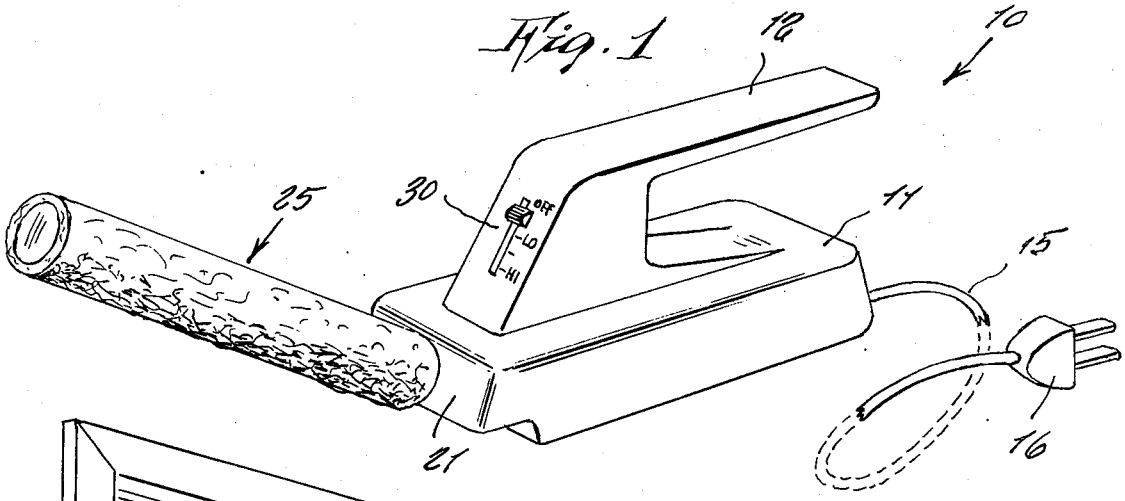
Fig. 2
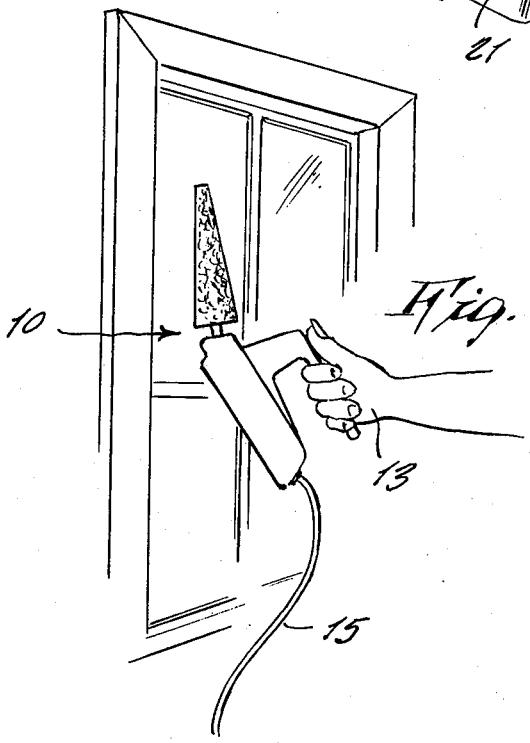
Fig. 4
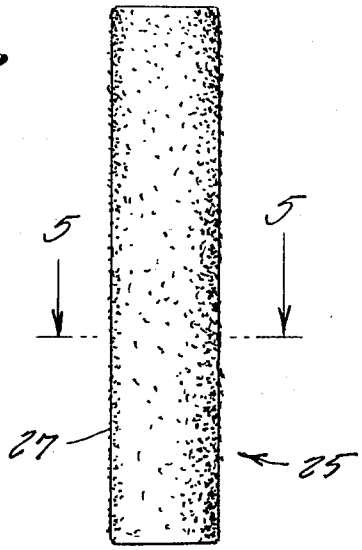
Fig. 5
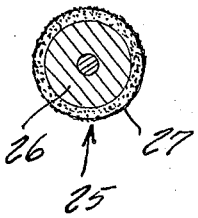
Fig. 3
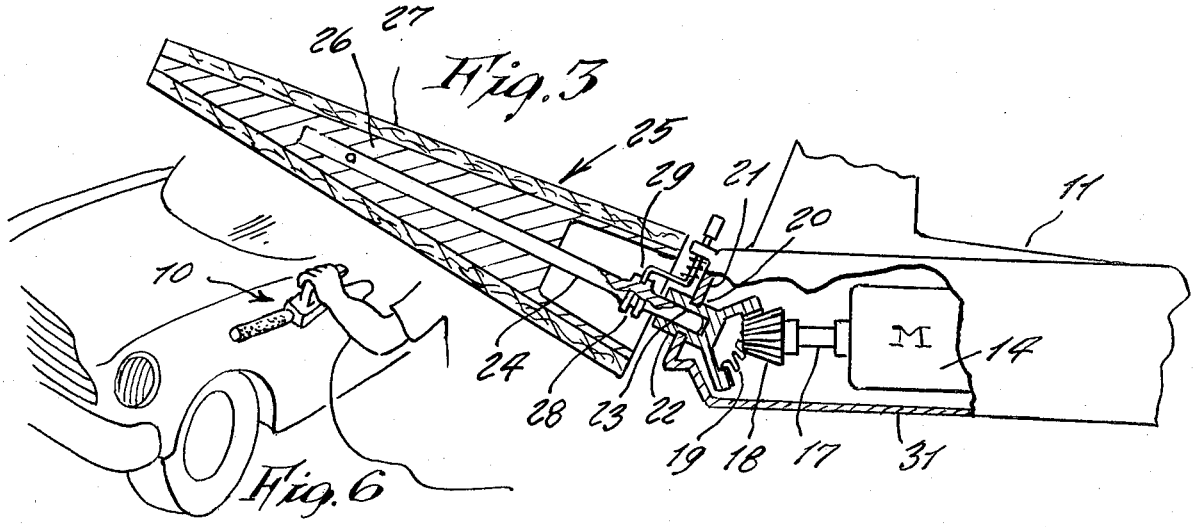
Fig. 6

AUTOMATIC CLEANER

This invention relates generally to electrical appliances.

A principal object of the present invention is to provide a portable hand tool for doing more easily and effortlessly such chores as scrubbing, scraping or polishing the surfaces of various objects.

Another object accordingly is to provide a tool which, for example, can be used to clean windows, sand or polish a car body, buff furniture, grind surfaces of metal castings in the manufacture of machinery, or the like.

Yet another object is to provide a tool which may be provided with interchangeable rollers, each of the rollers being used for a specific intended task, so that the tool together with a set of different rollers can be used to perform various different services in a home, office or factory and shop.

Other objects are to provide an anutomatic cleaner which is simple in design, inexpensive to manufacture, rugged in construction, easy to use and efficient in operation.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

FIG. 1 is a perspective view of the invention.

FIG. 2 shows a cone shaped form of the invention in use for washing a window.

FIG. 3 is a side cross sectional view of the invention and showing a tapered roller mounted thereupon.

FIG. 4 is a side view of a roller having a sand paper surface.

FIG. 5 is a cross section on line 5—5 of FIG. 4.

FIG. 6 shows the invention fitted with cylindrical shaped brush so to sand or polish a car fender.

Referring now to the drawing in etail, the reference numeral 10 represents a portable tool according to the present invention, which is illustrated in FIGS. 1 through 5 for use as an automatic cleaner.

The tool consists of a case 11 integral with a handle 12 for being held in a person's hand 13. The case contains an electric motor 14 together with suitable transformer connected to an extension cord 15 extending outwardly of the case and fitted on its outer end with a male plug 16 so that it can be plugged into a household electric outlet socket. The motor has a motor shaft 17 fitted with gear 18 that drives a gear 19 rotatably supported in a bearing 20 on a front wall 21 of the case. The hub 22 of the gear has a square socket opening 23 on its front side so to interchangeably receive a shaft 24 of a roller 25 that is used for a specific task.

The roller 25 consists of a core 26 fitted with a sleeve 27 secured thereto, the sleeve being of various materials in order to either perform a scrubbing, scrapping, brushing, polishing, cleaning or other action.

As shown in FIGS. 1, 4 and 6, the roller may be cylindrical shaped, or as shown in FIGS. 2 and 3, it may be cone shaped, or it may be any other shape, not shown, such as longitudinally concave or convex or may include annular grooves or ridges or may be longitudinally fluted.

The shaft 24 protrudes from a rear of the roller and is square in shape so to fit in the socket opening 23. An annular groove 28 around the shaft is engaged by a spring activated detent 29 so to prevent the shaft to disengage from the socket accidently while in operative use.

An electric rheostat switch 30 is in searies circuit with the motor so to control the motor speed operation.

In use, as shown, in FIGS. 2 and 4, the tool can be used to wash windows, work on a car body finish or do other useful work. It is to be noted that the axis of the roller is at an upwardly inclined angle respectiv to a bottom wall 31 of the case and no portion of the roller intercepts a flat plane of the bottom wall, so that the roller can lay flat against a work such as the window shown in FIG. 2.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. In a portable power tool adaptable for use as an automatic cleaner, the combination of a case integral with a handle, an electric motor inside said case being connected to an extension cord protruding outwardly to said case and fitted with a male plug, a shaft of said motor having a bevel first gear mounted thereupon, said first gear engaging a bevel internal second gear having a hub protruding outwardly through a front wall of said case, said hub being journalled in a bearing opening of said wall, an outer end of said hub having a square socket opening, and a plurality of rollers selectively engagable in said socket opening; each said roller comprising a core fitted with a sleeve of a material for frictionally rubbing against a work, and a shaft secured inside said core protruding from a rear end thereof for engaging said socket opening, said rear end of said core having a concentric, hollowed out recess through a center of which said roller shaft extends and wherein said roller shaft has an annular groove within said recess which is engagable by a detend support on said case, said detend comprising an offset member transversely slidable respective to an axis of said roller shaft, said detent being slidable in an opening in a protrusion formed on said front wall, and a compression coil spring between said protrusion and a right angle portion of said offset member normally urging said detent to engage said annular groove.

2. The combination as set forth in claim 1 wherein a rheostat switch on said handle is in series circuit with said motor.

3. The combination as set forth in claim 2 wherein said roller is conical in shape.

* * * * *